US005942887A

United States Patent [19]

Annema

[11] Patent Number: 5,942,887

[45] Date of Patent: Aug. 24, 1999

[54] BAND-GAP REFERENCE VOLTAGE SOURCE

[75] Inventor: Anne J. Annema, Eindhoven, Netherlands

[73] Assignee: U.S. Philips Corporation, New York, N.Y.

[21] Appl. No.: 08/962,154

[22] Filed: Nov. 3, 1997

[30] Foreign Application Priority Data

Nov. 8, 1996 [EP] European Pat. Off. ..... 96203137

[51] Int. Cl.[6] ..... G05F 3/16

[52] U.S. Cl. ..... 323/313; 323/315

[58] Field of Search ..... 323/313, 315, 323/907

[56] References Cited

U.S. PATENT DOCUMENTS 4,327,320 4/1982 Oguey et al. ..... 323/313
5,726,563 3/1998 Bolton, Jr. ..... 323/315

FOREIGN PATENT DOCUMENTS

0620515A1 10/1994 European Pat. Off. .

OTHER PUBLICATIONS

Eric A. Vittoz and Oliver Neyroud, "A Low–Voltage CMOS Bandgap Reference" IEEE Journal of Solid–State Circuits, vol. SC–14, No. 3, Jun. 1979, pp. 573–577.

*Primary Examiner*—Peter S. Wong
*Assistant Examiner*—Derek J. Jardieu
*Attorney, Agent, or Firm*—Brian J. Wieghaus

[57] ABSTRACT

A band-gap reference voltage source comprises a first current branch including a first field effect transistor (T1); a second current branch including a second field effect transistor (T2); a reference resistor (RRF) arranged in series with one of the field effect transistors (T1, T2); and a voltage level shifter for coupling the backgates (BG1, BG2) of the field effect transistors (T1, T2) to the gates (G1, G2) of the field effect transistors (T1, T2), which reduces the gate-source voltages of the field effect transistors (T1, T2). As a result of this, the output voltage supplied by the band-gap reference voltage source can be lower than customary.

22 Claims, 4 Drawing Sheets

BAND-GAP REFERENCE VOLTAGE SOURCE

BACKGROUND OF THE INVENTION

1. Field of the Invention

The invention relates to a band-gap reference voltage source comprising a first current branch including a first field effect transistor; a second current branch including a second field effect transistor; a reference resistor arranged in series with one of the field effect transistors; and means for producing different current densities in the first and in the second field effect transistor.

2. Description of Related Art

Such a band-gap reference voltage source is known from the publication: "A Low-Voltage CMOS Bandgap Reference", IEEE Journal of Solid-State Circuits, Vol. SC-14, No. 3, June 1979. Said publication describes a band-gap reference voltage source comprising MOS transistors. The current which flows through the MOS transistors is then so small that the MOS transistors are in the weak inversion mode, as a result of which the MOS transistors exhibit characteristics which are highly equivalent to those of bipolar transistors. Thus, it possible to use MOS transistors in order to make a band-gap reference voltage source whose circuit diagram corresponds to those of well-known band-gap reference voltage sources using bipolar transistors.

A drawback of the known band-gap reference voltage source is that it supplies an output voltage which is not low enough for some uses.

SUMMARY OF THE INVENTION

It is an object of the invention to provide a band-gap reference voltage source which mitigates the above-mentioned drawback.

To this end, according to the invention, the band-gap reference voltage source of the type defined in the opening paragraph is characterized in that, of at least one of the field effect transistors the respective field effect transistor has its back gate coupled to the gate of the respective field effect transistor by means of a voltage level shifter.

The invention is based on the recognition of the fact that the lower limit of a voltage supplied by a band-gap reference voltage source using field effect transistors is dictated by the minimum values of a voltage difference between a gate and a source of a field effect transistor.

In the case of, for example, a p-type field effect transistor having a p-type source, a p-type drain and an n-type backgate it is customary to make sure that the voltage on the n-type backgate is greater than or equal to the voltage on the p-type source. This prevents a diode formed by the p-type source and the n-type backgate from being turned on. The voltage level shifter serves to supply a forward voltage to the diodes of the first and the second field effect transistor. This has the advantage that it reduces the gate-source voltage differences of the first and the second field effect transistor, as a result of which the output voltage can also be smaller. For an optimum operation of the band-gap reference voltage source the forward voltages across the diodes should be smaller than the threshold voltages of the diodes.

BRIEF DESCRIPTION OF THE DRAWINGS

The invention will be described in more detail with reference to the accompanying drawings, in which.

In these Figures parts or elements having like functions or purposes bear the same reference symbols.

DETAILED DESCRIPTION OF THE PREFERRED EMBODIMENTS

Figure 1:
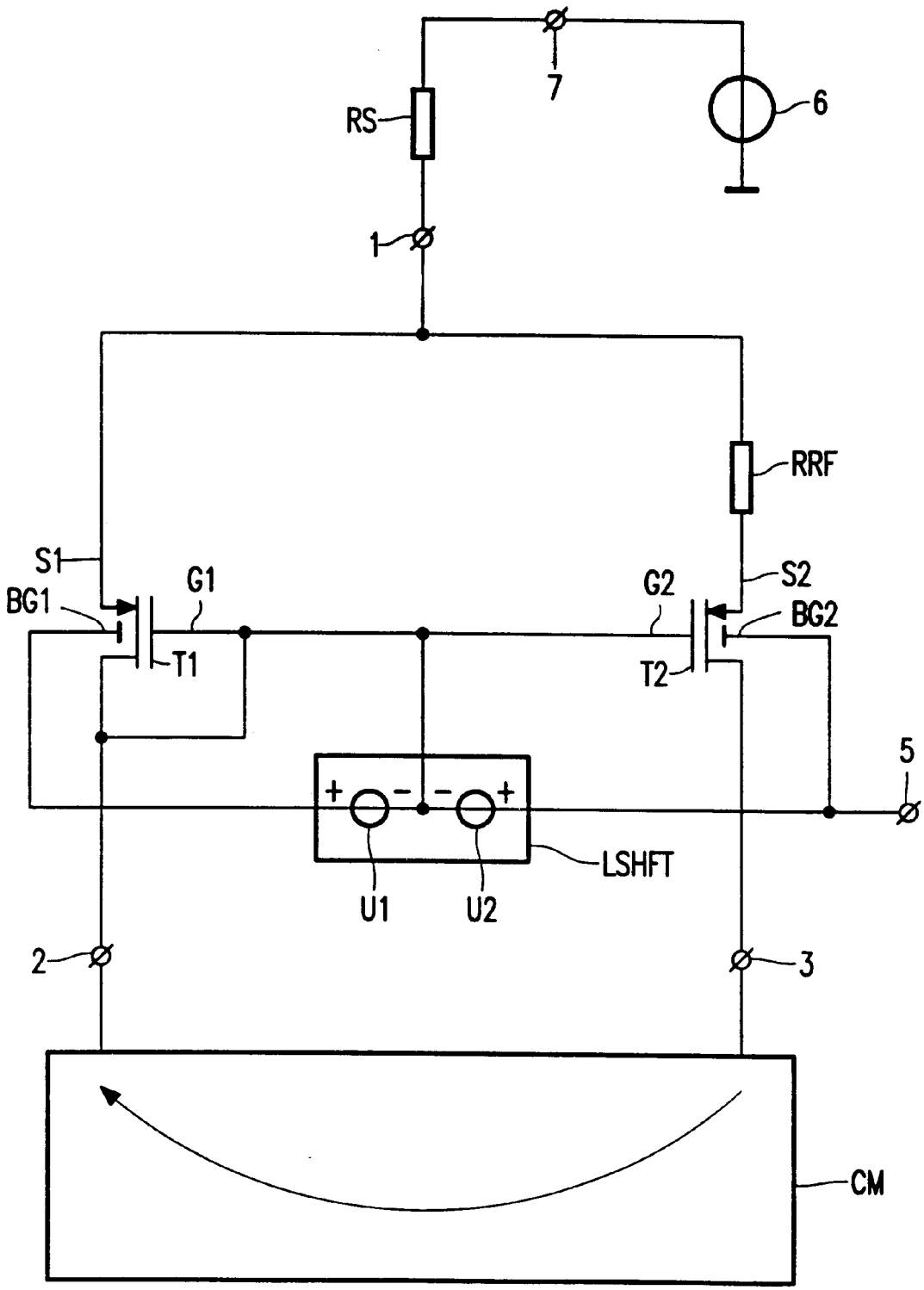
FIG. 1 is a basic circuit diagram of a band-gap reference voltage source in accordance with the invention.

FIG. 1 shows a basic circuit diagram of a band-gap reference voltage source in accordance with the invention.

The band-gap reference voltage source has a supply terminal 1 for receiving a supply voltage. The supply terminal 1 can be coupled, for example, to a supply voltage terminal 7 of a power supply 6 by means of a series resistor RS. The band-gap reference voltage source further comprises a reference resistor RRF having a first terminal coupled to the reference input terminal 1, and having a second terminal; a first field effect transistor T1 having a source S1 coupled to the supply terminal 1, a drain, a gate G1 coupled to the drain, and a backgate BG1; a second field effect transistor T2 having a source S2 coupled to the second terminal of the reference resistor RRF, a drain, a gate G2 coupled to the gate G1 of the first field effect transistor TI, and a backgate BG2; means for producing different current densities in the first and in the second field effect transistor T1, T2, i.e. a current mirror CM, having a first terminal 2 coupled to the drain of the first field effect transistor T1 and having a second terminal 3 coupled to the drain of the second field effect transistor T2. The band-gap reference voltage source further comprises a voltage level shifter LSHFT which couples the backgates BG1, BG2 of the first and the second field effect transistor T1, T2 to the gate G1 of the first field effect transistor T1. The band-gap reference voltage source further has an output reference terminal 5 coupled to the backgate BG2 of the second field effect transistor to supply an output voltage between the output reference terminal 5 and the supply terminal 1, or between the output reference terminal 5 and the supply voltage terminal 7.

If, by way of example, the field effect transistors T1, T2 are equally dimensioned the current densities in the first and in the second transistor T1, T2 will differ when the current ratio between the first and the second field effect transistor T1, T2 is not equal to unity, which ratio is defined by the current mirror CM. If a unity current ratio is selected the current densities in the first and the second transistor T1, T2 can differ when, in addition, the first and the second field effect transistor T1, T2 are dimensioned unequally.

The conventional parts T1, T2, RRF, CM and RS of the band-gap reference voltage source are dimensioned in the customary manner as known from the state of the art. In principle, the band-gap reference voltage source also produces an output voltage without the presence of the series resistor RS. However, when the series resistor RS is used it is possible to obtain an output voltage which is substantially temperature independent. The voltage level shifter LSHFT may comprise a first voltage source U1, coupled between the backgate BG1 and the gate G1 of the first field effect transistor T1, and a second voltage source U2, coupled between the backgate BG2 and the gate G2 of the second field effect transistor T2. The voltages supplied by the voltage sources U1, U2 can be selected in such a manner that a forward voltage is produced across the respective diodes, which are formed by the p-type sources S1, S2 and the n-type backgates BG1, BG2, without the threshold values of the diodes being exceeded.

Figure 2:
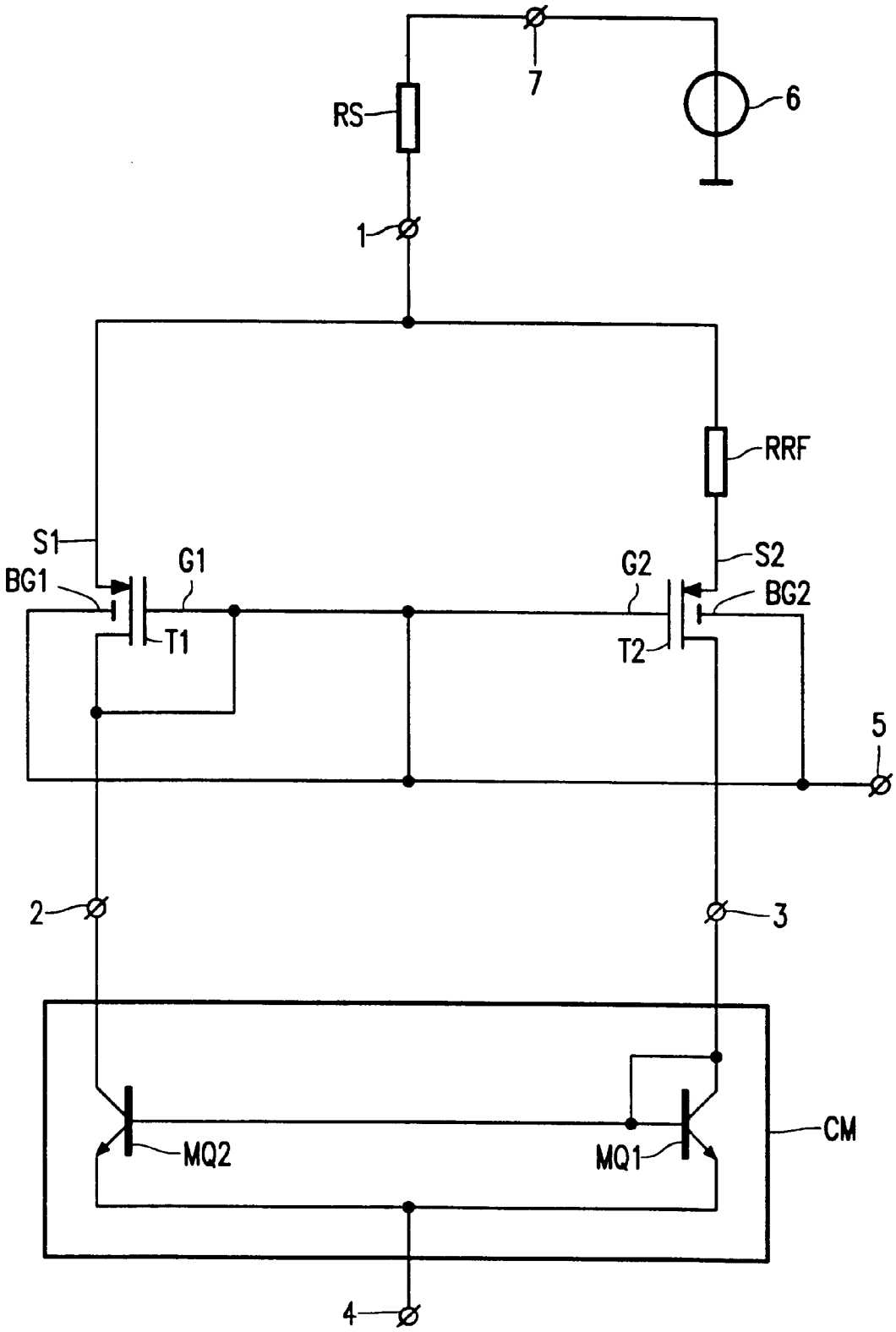
FIG. 2 shows a first embodiment of a band-gap reference voltage source in accordance with the invention.

FIG. 2 shows a first embodiment of a band-gap reference voltage source in accordance with the invention. In this embodiment the voltage sources U1, U2 as shown in FIG. 1 have been replaced by short-circuits. In this case this very simple embodiment can be used in an optimum manner when the types of field effect transistors T1, T2 are selected in such a manner (for example by selecting a suitable IC process) that the gate-source voltages of the field effect transistors T1, T2 are lower than the threshold values of the voltages across the diodes formed by the sources S1, S2 and the backgates BG1, BG2 of the field effect transistors.

The current mirror CM is, by way of example, a bipolar current mirror arrangement comprising an input current mirror MQ1 having a collector coupled to the second terminal 3, a base coupled to the collector, and an emitter coupled to a further supply terminal 4; and an output current mirror MQ2 having a collector coupled to the first terminal 2, a base coupled to the base of the input current mirror MQ1, and an emitter coupled to the further supply terminal 4.

Figure 3:
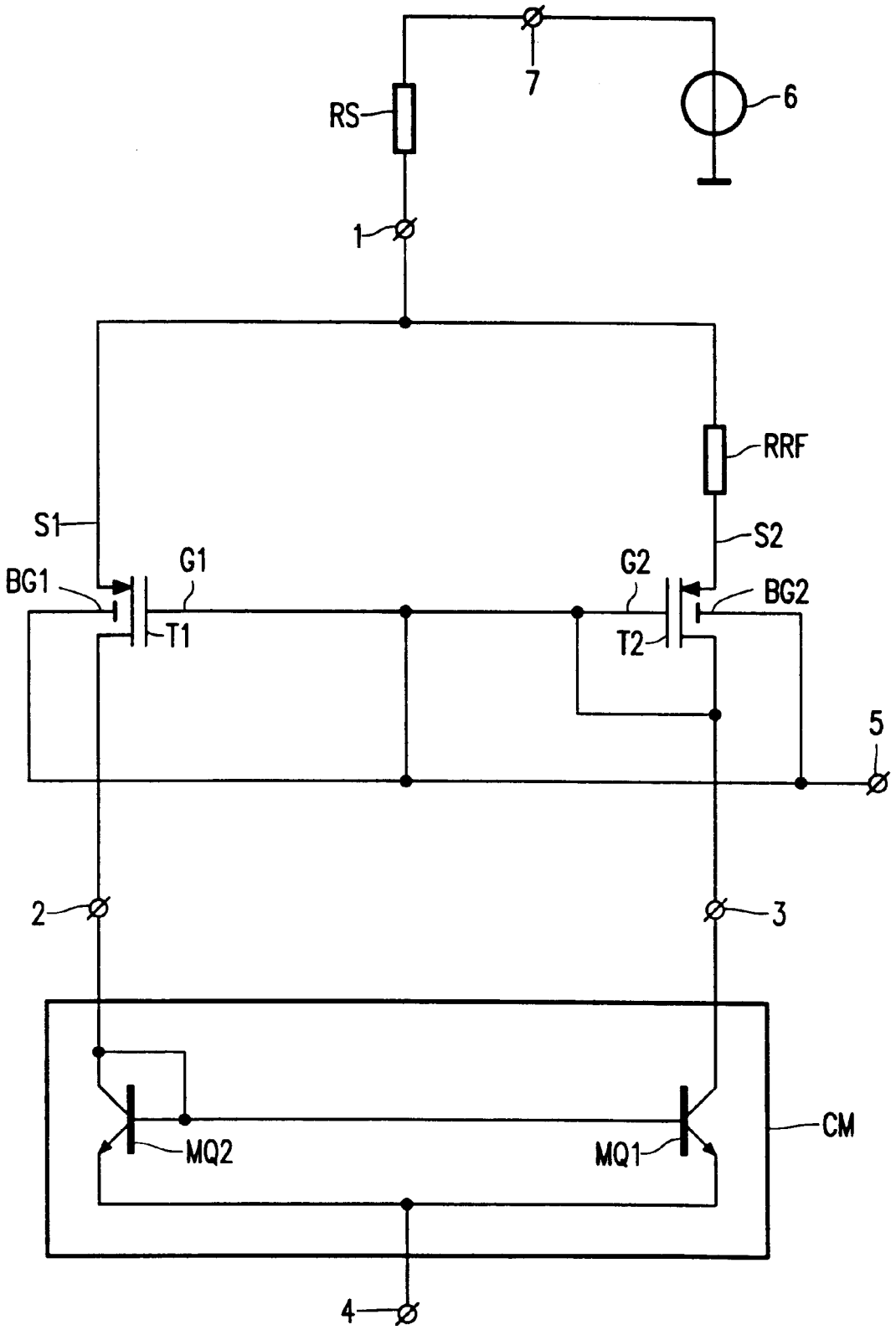
FIG. 3 shows a second embodiment of a band-gap reference voltage source in accordance with the invention.

FIG. 3 shows a second embodiment of a band-gap reference voltage source in accordance with the invention. As compared with the embodiment as shown in FIG. 2 the second field effect transistor T2, instead of the first field effect transistor T1, has been connected as a diode and the output current mirror transistor MQ2, instead of the input current mirror transistor MQ1, has been connected as a diode.

Figure 4:
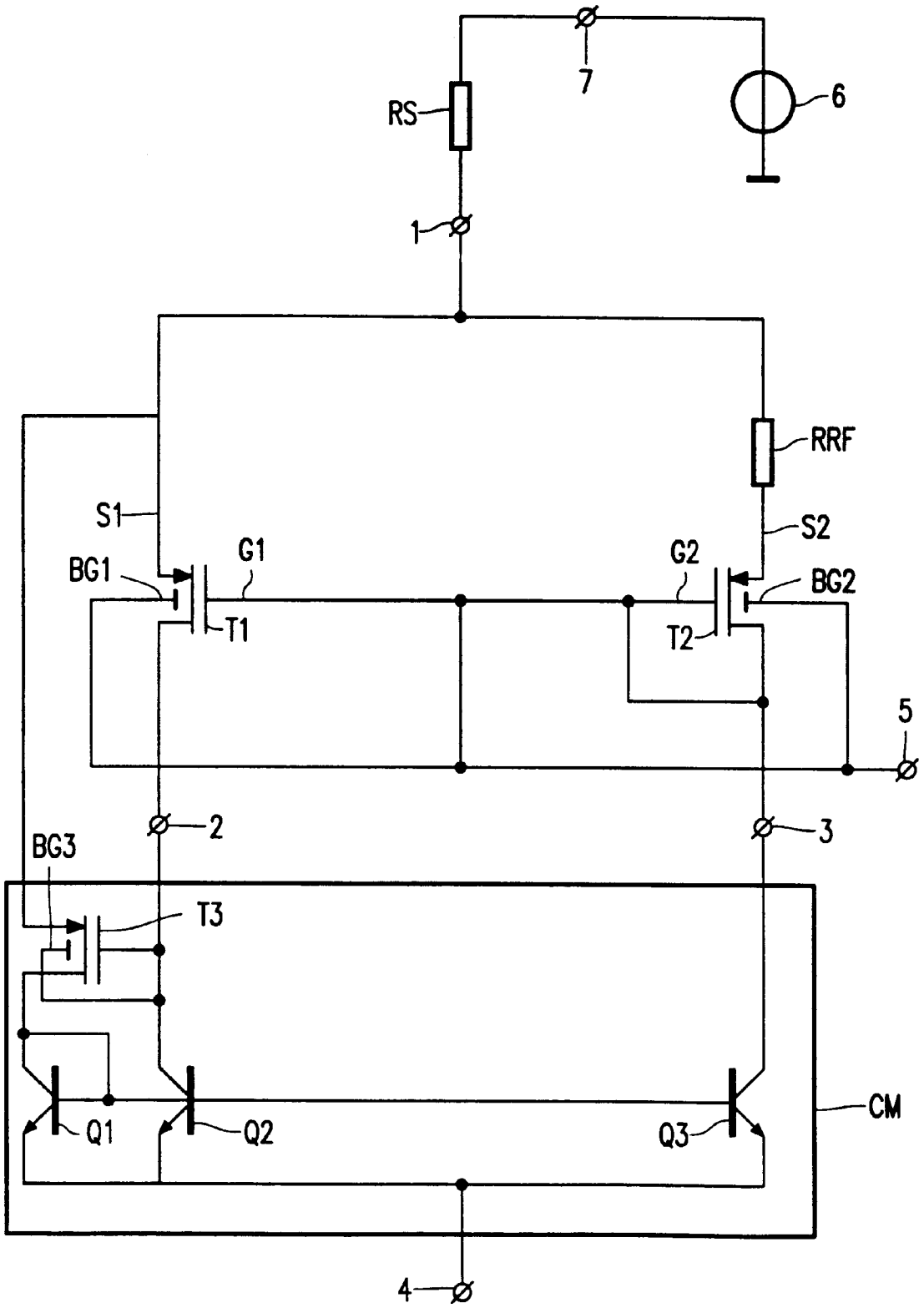
FIG. 4 shows a third embodiment of a band-gap reference voltage source in accordance with the invention.

FIG. 4 shows a third embodiment of a band-gap reference voltage source in accordance with the invention. The difference with the embodiment as shown in FIG. 3 resides in the special design of the current mirror CM, which comprises a third field effect transistor T3 having a source coupled to the supply terminal 1, a drain, a gate coupled to the first terminal 2, and a backgate BG3 coupled to the gate G3; a first transistor Q1 having a first main electrode coupled to the drain of the third field effect transistor T3, a second main electrode coupled to the further supply terminal 4, and a control electrode coupled to the first main electrode; a second transistor Q2 having a first main electrode coupled to the first terminal 2, a second main electrode coupled to the further supply terminal 4, and a control electrode coupled to the control electrode of the first transistor Q1; and a third transistor Q3 having a first main electrode coupled to the second terminal 3, a second main electrode coupled to the further supply terminal 4, and a control electrode coupled to the control electrode of the first transistor Q1.

In the case of a suitable dimensioning of the first, the second, and the third field effect transistor T1, T2, T3 with respect to one another the voltage on the first terminal 2 will be (substantially) equal to the voltage on the second terminal 3. This has the advantage that the output voltage is then less dependent upon supply voltage variations of the power supply 6. The degree of improvement of the independence of the output voltage on supply voltage variations increases as the gain of the control loop formed by the third field effect transistor T3, the first transistor Q1 and the second transistor Q2 increases.

In a manner similar to that shown in the basic circuit diagram of FIG. 1 a voltage level shifter LSHFT can be interposed between the gate and the backgate of the first field effect transistor T1, of the second field effect transistor T2, and of the third field effect transistor T3.

Instead of the P-type field effect transistors T1, T2, T3 shown in the Figure it is possible to use N-type field effect transistors. The current mirror CM can be implemented by means of bipolar (pnp or npn) transistors, by means of field effect transistors (P-type or N-type), or by means of a combination of bipolar and field effect transistors. The band-gap reference voltage source can be constructed as an integrated circuit or also by means of discrete components.

I claim:

1. A band-gap reference voltage source, comprising:

a first current branch including a first field effect transistor;

a second current branch including a second field effect transistor;

the first and second field effect transistor being of the same conductivity type, having gates with the same type of doping, and having backgates not connected to the source of the respective transistor, a reference resistor arranged in series with one of the field effect transistors;

a circuit which produces different current densities in the first and in the second field effect transistor; and at least one of the field effect transistors, having a backgate and a gate coupled to each other to reduce the gate-source voltage of said at least one field effect transistor.

2. A band-gap reference voltage source as claimed in claim 1, characterized in that a series resistor is arranged in series with the supply terminal.

3. A band gap reference voltage source according to claim 1, wherein a level shifter couples the gate to the backgate of said at least one of said field effect transistors.

4. A band-gap reference voltage source as claimed in claim 1, characterized in that a short-circuit couples the gate to the backgate of said at least one of said field effect transistors.

5. A band-gap reference voltage source as claimed in claim 4, characterized in that a short-circuit couples the gate to the backgate of said at least one of said field effect transistors.

6. A band-gap reference voltage source as claimed in claim 4, characterized in that a series resistor is arranged in series with the supply terminal.

7. A band-gap reference voltage source as claimed in claim 1, characterized in that:

the band-gap reference voltage source further comprises a supply terminal coupled to the source of one of the field effect transistors and to a terminal of the reference resistors, the reference resistor having another terminal coupled to the source of the other field effect transistor; and the gate of the first field effect transistor is coupled to the gate of the second field effect transistor.

8. A band-gap reference voltage source as claimed in claim 7, characterized in that a short-circuit couples the gate to the backgate of said at least one of said field effect transistors.

9. A band-gap reference voltage source as claimed in claim 7, characterized in that a series resistor is arranged in series with the supply terminal.

10. A band-gap reference voltage source as claimed in claim 7, characterized in that the circuit which produces different current densities in the first and in the second field effect transistor comprise a current mirror having a first terminal coupled to the drain of one of the field effect transistors and having a second terminal coupled to the drain of the other field effect transistor.

11. A band-gap reference voltage source as claimed in claim 10, characterized in that the current mirror comprises:

a third field effect transistor having:

a source coupled to the supply terminal, a drain, a gate coupled to the first terminal, and a backgate;

a first transistor having:

a first main electrode coupled to the drain of the third field effect transistor, a second main electrode coupled to a further supply terminal, and a control electrode coupled to the first main electrode;

a second transistor having:

a first main electrode coupled to the first terminal, a second main electrode coupled to the further supply terminal, and a control electrode coupled to the control electrode of the first transistor; and a third transistor having:

a first main electrode coupled to the second terminal, a second main electrode coupled to the further supply terminal, and a control electrode coupled to the control electrode of the first transistor.

12. A band-gap reference voltage source as claimed in claim 11, characterized in that the backgate of the third field effect transistor is coupled to the gate of the third field effect transistor.

13. A band-gap reference voltage source as claimed in claim 1, characterized in that the circuit which produces different current densities in the first and in the second field effect transistor comprise a current mirror having a first terminal coupled to the drain of one of the field effect transistors and having a second terminal coupled to the drain of the other field effect transistor.

14. A band-gap reference voltage source as claimed in claim 13, characterized in that a short-circuit couples the gate to the backgate of said at least one of said field effect transistors.

15. A band-gap reference voltage source as claimed in claim 13, characterized in that a series resistor is arranged in series with the supply terminal.

16. A band-gap reference voltage source as claimed in claim 13, characterized in that the current mirror comprises:

a third field effect transistor having:

a source coupled to the supply terminal a drain, a gate coupled to the first terminal, and a backgate;

a first transistor having:

a first main electrode coupled to the drain of the third field effect transistor, a second main electrode coupled to a further supply terminal, and a control electrode coupled to the first main electrode;

a second transistor having:

a first main electrode coupled to the first terminal, a second main electrode coupled to the further supply terminal, and a control electrode coupled to the control electrode of the first transistor; and a third transistor having:

a first main electrode coupled to the second terminal, a second main electrode coupled to the further supply terminal, and a control electrode coupled to the control electrode of the first transistor.

17. A band-gap reference voltage source as claimed in claim 16, characterized in that a short-circuit couples the gate to the backgate of said at least one of said field effect transistors.

18. A band-gap reference voltage source as claimed in claim 16, characterized in that a series resistor is arranged in series with the supply terminal.

19. A band gap reference voltage source according to claim 16, wherein a level shifter couples the gate to the backgate of said at least one of said field effect transistors.

20. A band-gap reference voltage source as claimed in claim 19, characterized in that the backgate of the third field effect transistor is coupled to the gate of the third field effect transistor.

21. A band-gap reference voltage source as claimed in claim 20, characterized in that a further voltage level shifter couples the gate and backgate of said third field effect transistor.

22. A band-gap reference voltage source as claimed in claim 20, characterized in that a series resistor is arranged in series with the supply terminal.

* * * * *